US007721983B2

(12) United States Patent
Kitaguchi

(10) Patent No.: US 7,721,983 B2
(45) Date of Patent: May 25, 2010

(54) CRUSHER

(75) Inventor: Atsushi Kitaguchi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 422 days.

(21) Appl. No.: 11/758,249

(22) Filed: Jun. 5, 2007

(65) Prior Publication Data

US 2007/0284465 A1 Dec. 13, 2007

(30) Foreign Application Priority Data

Jun. 7, 2006 (JP) ..... 2006-158536

(51) Int. Cl.
*B02C 13/09* (2006.01)

(52) U.S. Cl. ..... 241/189.1; 241/186.35

(58) Field of Classification Search ..... 241/189.1, 241/186.35, 186.2

See application file for complete search history.

(56) References Cited

U.S. PATENT DOCUMENTS 1,840,749 A * 1/1932 Stresau ..... 241/191
2,931,581 A * 4/1960 Lykken et al. ..... 241/52
3,170,643 A * 2/1965 Hanse et al. ..... 241/189.1
3,764,080 A * 10/1973 Wagner ..... 241/185.5
3,813,045 A * 5/1974 Greiffenstern ..... 241/88.4
4,030,865 A * 6/1977 Kobayashi ..... 425/82.1
4,146,184 A * 3/1979 Whitney ..... 241/73
4,361,290 A * 11/1982 Francis ..... 241/57
4,650,129 A * 3/1987 Newell et al. ..... 241/73
5,513,811 A * 5/1996 Phan Hung ..... 241/189.1
5,772,134 A * 6/1998 Bouldin et al. ..... 241/79.1
5,947,395 A 9/1999 Peterson et al.
5,975,443 A * 11/1999 Hundt et al. ..... 241/27
6,070,818 A * 6/2000 Taylor ..... 241/189.1

* cited by examiner

*Primary Examiner*—Bena Miller
(74) *Attorney, Agent, or Firm*—Mattingly & Malur, P.C.

(57) ABSTRACT

A crusher comprises a crushing rotor being rotatable and having a crushing bit to crush target materials to be crushed, a feed conveyor for conveying the target materials toward the crushing rotor, and a pressing feeder unit including a pressing roller disposed above the feed conveyor and introducing the target materials on the feed conveyor toward the crushing rotor while pressing the target materials from above, and an anvil disposed at a position which is closer to the crushing rotor than a point where the pressing roller presses the target materials and which is outward of the crushing rotor in the radial direction. The fixed bit has a bumping surface, against which the target materials bump, disposed in an opposed relation to the rotating direction of the crushing bit, thereby crushing the target materials introduced toward the crushing rotor.

6 Claims, 10 Drawing Sheets

CRUSHER

BACKGROUND OF THE INVENTION

1. Field of the Invention

The present invention relates to a crusher capable of efficiently crushing target materials to be crushed.

2. Description of the Related Art

For the purposes of mainly promoting reuse of waste materials and reducing the volume thereof, crushers are employed to crush various kinds of materials to be crushed. Some of those crushers are used to crush primarily cut limbs and timbers from thinning, which are generated with land development, maintenance and other operations made in forests, branches generated by trimming trees cut in forests, and scrap woods generated with pulling-down of wooden houses, etc.

One known such crusher includes a feed conveyor for conveying target materials, which are loaded to be crushed, toward a crushing chamber, a pressing roller for pressing the target materials to be crushed from above, which are conveyed on the feed conveyor, a crushing bit for crushing the target materials introduced by cooperation of the feed conveyor and the pressing roller, and a screen (sieve member) for discharging the materials having been crushed outward of the crushing chamber while selecting the grain size of the crushed materials. Further, in one example of that type of crusher, the crushing bit smashes against the target materials to be crushed from below, which are introduced to the crushing chamber while being gripped by the feed conveyor and the pressing roller, thereby crushing the target materials (see, e.g., U.S. Pat. No. 5,947,395).

SUMMARY OF THE INVENTION

With the crushing method of smashing the crushing bit against the target materials to be crushed from below as in the above-described technique, the target materials can be crushed into finer chips when a point (support point) where the target materials to be crushed are pressed and supported from above at the time of smashing by the crushing bit is positioned closer to a point (smashing point) where the crushing bit smashes against the target materials to be crushed. In the above-described technique, the support point where the target materials to be crushed are supported is a contact point between the pressing roller and the target materials. In trying to position the support point closer to the smashing point, however, there is a limit because of the problem with mechanical layout, e.g., the arrangement of the pressing roller and a crushing rotor. With the above-described technique, therefore, the support point and the smashing point tend to locate away from each other, whereby the target materials cannot be finely crushed and are roughly crushed by the crushing bit. Accordingly, in some cases, a longer time is required until the roughly-crushed target materials are finely crushed, and the crushed materials having relatively large sizes are discharged through the screen as they are. This may result in lowering of the crushing efficiency and a reduction in grain size quality of the crushed materials.

An object of the present invention is to provide a crusher capable of efficiently producing crushed materials with good grain size quality.

To achieve the above object, according to a first aspect, the present invention provides a crusher comprising a crushing rotor being rotatable and having a crushing bit to crush target materials to be crushed; a feed conveyor for conveying the target materials toward the crushing rotor; and a pressing feeder unit including a pressing roller disposed above the feed conveyor and introducing the target materials on the feed conveyor toward the crushing rotor while pressing the target materials from above, and a fixed bit disposed at a position which is closer to the crushing rotor than a point where the pressing roller presses the target materials and which is outward of the crushing rotor in the radial direction, the fixed bit having a bumping surface, against which the target materials bump, disposed in an opposed relation to the rotating direction of the crushing bit, thereby crushing the target materials introduced toward the crushing rotor.

According to a second aspect, in the crusher according to the first aspect, the bumping surface of the fixed bit is preferably arranged at a level not lower than the height of a lower end portion of the pressing roller during crushing operation.

According to a third aspect, in the crusher according to the first aspect, the fixed bit is preferably replaceable with another type of fixed bit.

According to a fourth aspect, in the crusher according to the third aspect, a gap size from a part of the fixed bit closest to the crushing rotor to a maximum locus of rotation of the crushing bit is preferably adjustable by replacing the fixed bit with another type of fixed bit.

To achieve the above object, according to a fifth aspect, the present invention provides a crusher comprising a crushing rotor being rotatable and having a crushing bit to crush target materials to be crushed; a feed conveyor for conveying the target materials toward the crushing rotor; and a pressing feeder unit including a pressing roller disposed above the feed conveyor and introducing the target materials on the feed conveyor toward the crushing rotor while pressing the target materials from above, and a support-point constituting portion disposed at a position closer to the crushing rotor than a point where the pressing roller presses the target materials, the support-point constituting portion acting, when the crushing bit smashes against the target materials introduced toward the crushing rotor, to press the target materials toward the feed conveyor side.

To achieve the above object, according to a sixth aspect, the present invention provides a crusher comprising a crushing rotor being rotatable and having a crushing bit to crush target materials to be crushed; a feed conveyor for conveying the target materials toward the crushing rotor; a pressing feeder unit including a pressing roller disposed above the feed conveyor and introducing the target materials on the feed conveyor toward the crushing rotor while pressing the target materials from above, and a first fixed bit disposed at a position which is closer to the crushing rotor than a point where the pressing roller presses the target materials and which is outward of the crushing rotor in the radial direction, the first fixed bit having a bumping surface, against which the target materials bump, disposed in an opposed relation to the rotating direction of the crushing bit, thereby acting, when the crushing bit smashes against the target materials introduced toward the crushing rotor, to press the target materials toward the feed conveyor side for crushing of the target materials; and a second fixed bit disposed at a position downstream of the first fixed bit in a direction in which the target materials are forced to move and which is outward of the crushing rotor in the radial direction, the second fixed bit having a bumping surface, against which the target materials bump, disposed in an opposed relation to the rotating direction of the crushing bit, thereby further crushing the target materials having been crushed by the first fixed bit.

DESCRIPTION OF THE PREFERRED EMBODIMENTS

Embodiments of a crusher according to the present invention will be described below with reference to the drawings.

Figure 1:
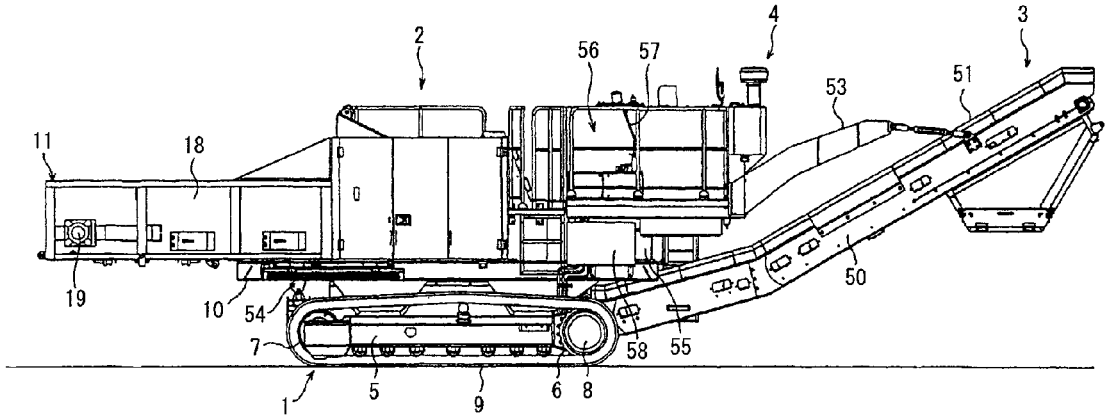
FIG. 1 is a side view of a crusher according to a first embodiment of the present invention.
Figure 2:
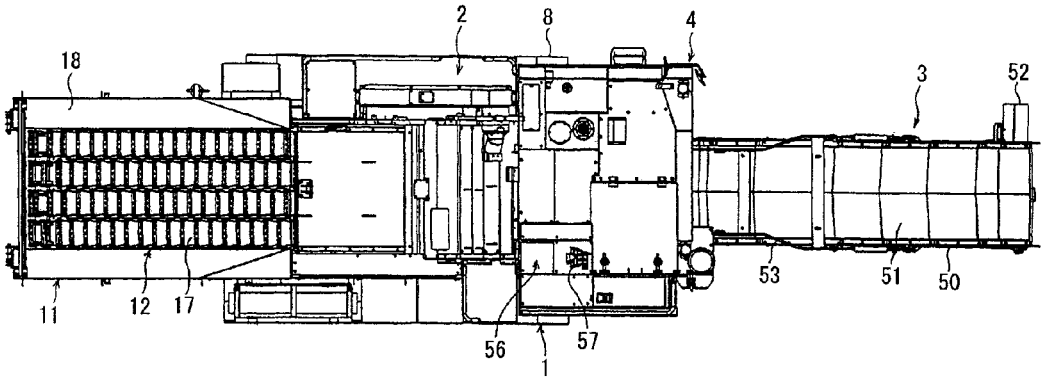
FIG. 2 is a plan view of the crusher according to the first embodiment of the present invention.
Figure 3:
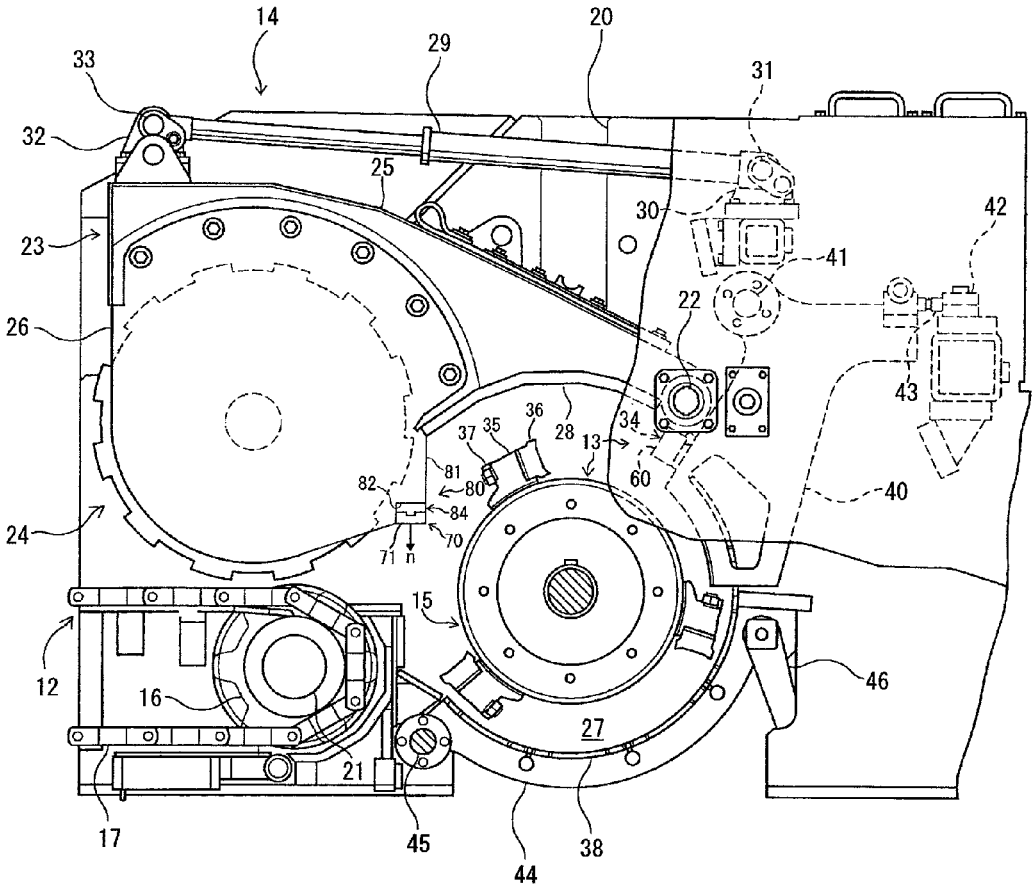
FIG. 3 is a side view showing a structure in the vicinity of a crushing apparatus provided in the crusher according to the first embodiment of the present invention.

FIG. 1 is a side view showing an overall structure of a crusher according to a first embodiment of the present invention, FIG. 2 is a plan view of the crusher shown in FIG. 1, and FIG. 3 is a side view showing a structure in the vicinity of a crushing apparatus 13 (described later) provided in the crusher shown in FIG. 1. Note that, in the following description, directions corresponding to the left and right in FIG. 1 are assumed to represent respectively the rear and front of the crusher or one side and the other side thereof.

The crusher shown in FIGS. 1 to 3 comprises mainly a travel body 1 capable of being self-propelled, a crushing function structure 2 installed on the travel body 1 and crushing target materials loaded to be crushed, a discharge conveyor 3 for conveying the materials having been crushed in the crushing function structure 2 and discharging the crushed materials to the exterior of the crusher, and motive power equipment (power unit) 4 including a power source, such as an engine, for various components mounted in the crusher.

The travel body 1 comprises a track frame 5, a drive wheel 6 and a driven wheel 7 disposed respectively at longitudinal opposite ends of the track frame 5, a driving unit (hydraulic motor for travel) 8 having an output shaft coupled to a shaft of the drive wheel 6, and a crawler (caterpillar belt) 9 looped over the drive wheel 6 and the driven wheel 7. A body frame 10 is disposed on the track frame 5. The body frame 10 supports the crushing function structure 2, the discharge conveyor 3, the power unit 4, etc.

The crushing function structure 2 comprises a hopper 11 for receiving the loaded target materials, a feed conveyor 12 (see FIG. 2) serving as feed means for feeding the target materials loaded into and received by the hopper 11, a crushing apparatus 13 (see FIG. 3) for crushing the target materials introduced by the feed conveyor 12, and a pressing feeder unit 14 (see FIG. 3) for pressing the target materials, which are going to be introduced to the crushing apparatus 13, against the feed conveyor 12 at a position in front of the crushing apparatus 13.

The feed conveyor 12 conveys the target materials toward a crushing rotor 15 (described later), and it comprises a sprocket-like drive wheel 16 (see FIG. 3) disposed on the side close to the crushing rotor 15 (described later), a driven wheel (not shown) disposed on the opposite side (i.e., on the rear side of the wood crusher), and running members (i.e., conveyor belts or chain belts) 17 which are looped between the drive wheel 16 and the driven wheel at opposite ends of the feed conveyor 12 in the feed direction and which are disposed in plural rows (four in this embodiment, see FIG. 2) side by side in the transverse direction. The driven wheel is supported by a bearing 19 (see FIG. 1) mounted to a rear portion of a side wall 18 (see FIG. 1) of the hopper 11, and the drive wheel 16 is supported by a bearing (not shown) mounted to a side cover 20 of the crushing apparatus 13, the side cover 20 being provided forward of the side wall 18. Thus, the feed conveyor 12 is disposed to substantially horizontally extend from a lower position inside the hopper 11, i.e., the inner side of the side wall 18 of the hopper 11, to a position near the crushing rotor 15 (described later) such that the feed conveyor 12 is entirely accommodated within the hopper 11 and the side cover 20 of the crushing apparatus 13. A rotary shaft 21 of the drive wheel 16 of the feed conveyor 12 is coupled through, e.g., a coupling to an output shaft of a driving unit (not shown) that is provided externally of the bearing in the transverse direction. By rotating the not-shown driving unit, the feed conveyor 12 is driven to move the conveyor running members 17 between the drive wheel 16 and the driven wheel in a circulating manner.

The pressing feeder unit 14 is provided adjacently rearward of the crushing rotor 15 (described later) above the feed conveyor 12 in an opposed relation to its conveying surface. With such an arrangement, the pressing feeder unit 14 introduces the target materials on the feed conveyor 12 toward the crushing rotor 15 while pressing the target materials from above. On that occasion, an anvil (first fixed bit) 70 (described later) presses the target materials toward the feed conveyor 12 side for crushing of the target materials.

The pressing feeder unit 14 comprises a support member (arm) 23 which has a rotary shaft 22 supported above the crushing apparatus 13 by a bearing provided in the side cover 20 such that the support member 23 is rotatable in a vertical plane (i.e., swingable up and down), a pressing roller 24 provided rotatably relative to the support member 23 and introducing the target materials to be crushed toward the crushing rotor 15 while pressing the target materials on the feed conveyor 12 from above, and the anvil 70 disposed at a position which is closer to the crushing rotor 15 than a point where the pressing roller 24 presses the target materials and which is outward of the crushing rotor 15 in the radial direction. The anvil 70 has a bumping surface 71, against which the target materials bump, disposed in an opposed relation to the rotating direction of a crushing bit 36 (described later).

The support member 23 comprises an arm portion 25 provided with the rotary shaft 22, and a bracket portion 26 provided at the distal end side of the arm portion 25 and supporting the pressing roller 24. A lower end surface of the arm portion 25 is formed to curve in a circular-arc shape, and a curved plate 28 defining a part of a crushing chamber 27 (described later) is attached to the curved lower end surface of the arm portion 25. On the other hand, a mount area of the bracket portion 26 to which the pressing roller 24 is mounted is formed in a circular-arc shape having a smaller diameter than the pressing roller 24 such that an outer circumferential surface of the pressing roller 24 projects out of the bracket portion 26.

The dimension of the pressing roller 24 in the transverse direction (i.e., in the direction perpendicular to the drawing sheet of FIG. 3) is set equal to or larger than the width of the conveying surface of the feed conveyor 12. Though not specifically shown, the pressing roller 24 includes a driving unit mounted within its barrel. The pressing roller 24 is rotated by the not-shown driving unit substantially at the same circumferential speed as the feed speed of the target materials which are conveyed on the conveying surface of the feed conveyor 12, thereby introducing the pressed target materials on the feed conveyor 12 toward the crushing chamber 27 (described later) in cooperation with the feed conveyor 12.

The bracket portion 26 has a projected portion 80 which is projected into the crushing chamber 27 in a direction toward the crushing rotor 15 (described later). The projected portion 80 includes a wall 81 which is extended in the transverse direction of a crusher body and covers the pressing roller 24 from the crushing chamber 27 side, and also includes a recess 82 formed at the lower end (at the side closer to the feed conveyor 12) of the wall 81 so as to face the crushing chamber 27. A bracket 84 having a protrusion 83 (see FIG. 4) is mounted to the recess 82, and the anvil 70 is mounted to the bracket 84.

The anvil (first fixed bit) 70 has a bumping surface 71 against which the target materials bump, the bumping surface 71 being disposed in an opposed relation to the rotating direction of the crushing bit 36 (described later), a recess 72 (see FIG. 4) to which is fitted the protrusion 83 of the bracket 84, a side surface 73 (see FIG. 4) formed continuously with the wall 81 and positioned on the side closer to the crushing rotor 15, and an edge 74 (see FIG. 4) formed by the bumping surface 71 and the side surface 73. The anvil 70 thus constituted operates such that, when the crushing bit 36 smashes against the target materials introduced toward the crushing rotor 15, the anvil 70 presses the target materials toward the feed conveyor 12 side for crushing of the target materials. A normal line n represents a normal direction of the bumping surface 71 on the side opposite to the recess 72. The anvil 70 is mounted to the bracket 26 in a replaceable manner by bolts, for example, while the recess 72 is fitted to the protrusion 83 of the bracket 84. Thus, because of the fitting between the recess 72 and the protrusion 83, the anvil 70 has a structure being durable against an impact. In particular, the anvil 70 has superior durability against external forces acting in the outward radial direction of the crushing rotor 15. Additionally, when the anvil 70 is mounted to the bracket portion 26, it may be directly mounted to the recess 82 instead of using the bracket 84 as in the above-described example.

The anvil 70 will be described in more detail below with reference to FIG. 4.

Figure 4:
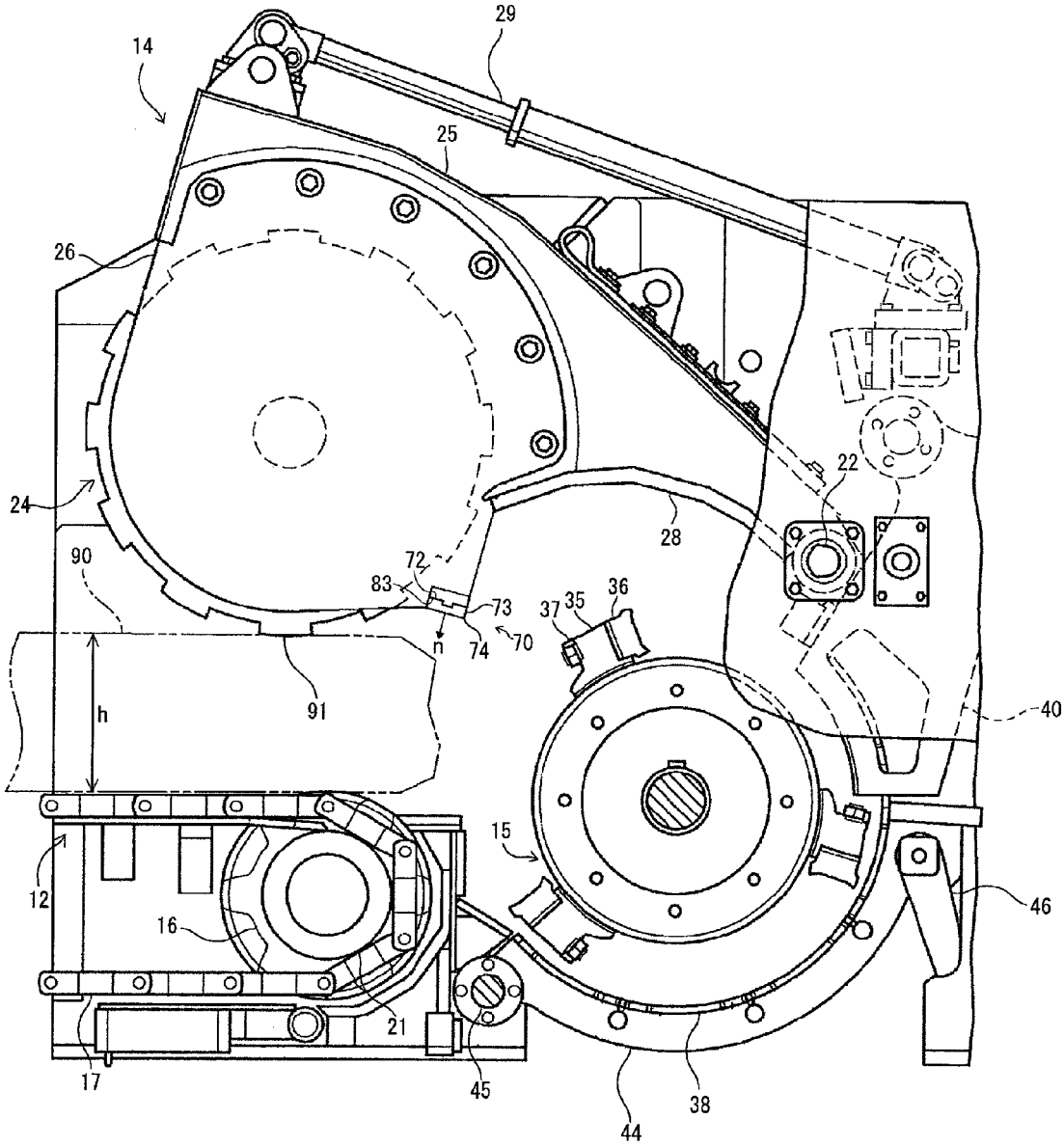
FIG. 4 is a side view showing a state of the structure shown in FIG. 3 during the crushing operation.

FIG. 4 shows a state of the structure shown in FIG. 3 during the crushing operation. In FIG. 4, the same components as those in FIGS. 1-3 are denoted by the same reference numerals (such notation is similarly applied to other drawings described later), and a description of those components is omitted here.

Referring to FIG. 4, target materials 90 to be crushed are woods loaded into the crusher and have a height h in the direction of height of the crusher body. The pressing feeder unit 14 holds a posture (crushing posture) in which it is rotated upward by the target materials 90 about the rotary shaft 22 and is pushed upward to a level corresponding to the height h of the target materials 90. The pressing roller 24 contacts the target materials 90 at a contact portion 91 located at the lower end of the pressing roller 24 in the crushing posture, thereby pressing the target materials 90 toward the feed conveyor 12 side at the contact portion 91 by the dead weight of the pressing roller 24.

The bumping surface 71 of the anvil 70 is disposed at a level not lower than the height of the contact portion 91 (i.e., not lower than a position above the conveying surface of the feed conveyor 12 by the height h), and it is arranged such that, in the crushing posture, the normal line n is directed to the rear side of the crusher body (i.e., the lower left direction in FIG. 4) in an opposed relation to the rotating direction of the crushing bit 36. By thus mounting the anvil 70 to the bracket portion 26 with the normal line n directed to the rear side of the crusher body during the crushing operation, the edge 74 of the anvil 70 becomes more prominent and can more sharply crush the target materials 90.

Also, the anvil 70 is preferably mounted to the bracket portion 26 such that, during the crushing operation, a part of the bumping surface 71 is positioned at a level of the height h. With such an arrangement, when the crushing bit 36 smashes against the target materials 90 introduced to the crushing chamber 27, the anvil 70 restricts the target materials 90 from being raised upward, whereby energy of the bumping can be efficiently utilized as crushing energy. Hence the crushing efficiency is increased.

Returning to FIGS. 1-3, a hydraulic cylinder (arm drive means) 29 is rotatably coupled at its bottom-side end to a bracket 30 through a pin 31, the bracket 30 being fixed to the crusher side cover 20. Also, the hydraulic cylinder 29 is rotatably coupled at its rod-side end to a bracket 32 through a pin 33, the bracket 32 being provided at an end of the arm portion 25 on the rear side (i.e., the left side as viewed in FIG. 3). The hydraulic cylinder 29 rotates the pressing feeder unit 14 about the rotary shaft 22 such that the pressing feeder unit 14 can be raised and lowered relatively to the feed conveyor 12 (i.e., the crushing apparatus 13) (namely, the pressing feeder unit 14 is movable away from and closer to the crushing apparatus 13).

The crushing apparatus 13 is mounted substantially on a central portion of the body frame 10 (see FIG. 1) in the longitudinal direction. As shown in FIG. 3, the crushing apparatus 13 comprises the crushing rotor 15 rotating within the crushing chamber 27 at a high speed, an anvil (second fixed bit) 34 disposed outward of the crushing rotor 15 in the radial direction and having a bumping surface (described later) arranged in an opposed relation to the rotating direction (also called the forward rotating direction, as required, i.e., the clockwise direction in FIG. 3) of the crushing rotor 15, and the anvil (first fixed bit) 70 provided on the pressing feeder unit 14 as described above.

The crushing rotor 15 is rotatably supported by bearings (not shown) each of which is mounted to, e.g., the side cover 20 of the crushing apparatus 13 (or a not-shown support member separately provided on the body frame 10). A plurality of support members 35 and crushing bits (i.e., smashing plates or crushing blades) 36 mounted respectively to the support members 35 are provided on an outer circumferential surface of the crushing rotor 15. The crushing bits 36 are arranged such that their edge faces precede the corresponding support members 35 when the crushing rotor 15 is rotated in the forward direction. Also, the crushing bits 36 are fixed to the support members 35 by bolts 37 or the likes, and therefore they are easily replaceable when worn out.

Outward of the crushing rotor 15 in the radial direction, the curved plate 28, the anvil 34, and a screen (sieve member) 38 are successively disposed in this order from a point where the target materials to be crushed are introduced toward the crushing rotor 15 (i.e., from a position near the surrounding of the pressing roller 24) in an upstream-to-downstream direction in which the target materials are carried (i.e., in the forward rotating direction of the crushing bits 36). The crushing chamber 27 is a space substantially defined by the curved plate 28, the anvil 34, the screen 38, etc. The crushing chamber 27 is opened at the same side as both the feed conveyor 12 and the pressing feeder unit 14 (i.e., the left side as viewed in FIG. 3) to provide a target-material receiving area.

The anvil (second fixed bit) 34 has a surface (bumping surface) 60 against which the target materials introduced to the crushing chamber 27 bump, and it is mounted to a holding member 40 such that the bumping surface 60 is positioned in an opposed relation to the rotating direction of the crushing rotor 15. The holding member 40 has a rotary shaft 41 and is coupled through a shear pin 43 to a support member 42 fixed to the side cover 20. For example, when an impact load exceeding an allowable value of the shear pin 43 is applied to the anvil 34, the shear pin 43 is broken and the holding member 40 is released from a restricted state. Thus, the holding member 40 is rotated about the rotary shaft 41 to retreat from the crushing chamber 27.

The screen (sieve member) 38 has discharge holes (not shown) for discharging the materials having been crushed outward of the crushing chamber 27 while selecting the grain size of the crushed materials, and it is held at a position around the crushing rotor 15 by a frame-like screen holding member (screen holder) 44. The screen holding member 44 has a rotary shaft 45 provided at one end of the screen holding member 44 on one side (i.e., the left side as viewed in FIG. 3) in the circumferential direction thereof (i.e., in the circumferential direction of the crushing rotor 15), and also has a support member 46 mounted to the other end of the screen holding member 44 on the other side (i.e., the right side as viewed in FIG. 3) in the circumferential direction thereof. During the crushing operation, the screen holding member 44 is held in a posture, shown in FIG. 3, by the support member 46. However, when the screen holding member 44 is released from the state restricted by the support member 46, it is rotated about the rotary shaft 45. With the rotation of the screen holding member 44, the screen 38 is also released from a restricted state, whereby the screen 38 can be replaced.

The discharge conveyor 3 mainly comprises a frame 50, a conveyor cover 51 disposed over a conveyor belt (not shown) looped between a drive wheel (not shown) and a driven wheel (not shown) which are disposed at opposite ends of the frame 50 in the longitudinal direction thereof, a driving unit 52 (i.e., a hydraulic motor for the discharge conveyor) for rotating the drive wheel. A portion of the discharge conveyor 3 on the discharge side (i.e., its portion on the front side or the right side as viewed in FIGS. 1 and 2) is supported in a suspended state by a support member 53 projecting from the power unit 4. Also, another portion of the discharge conveyor 3 on the opposite side (i.e., its portion on the rear side or the left side as viewed in FIGS. 1 and 2) is supported by a support member 54 in a state suspended from the body frame 10. Thus, the discharge conveyor 3 is supported by the support members 53 and 54 so as to pass under the crushing apparatus 13 and the power unit 4, and to further extend externally forward of the crusher while inclining upward. By rotating the driving unit 52, the conveyor belt is driven to circulate between the drive wheel and the driven wheel.

The power unit 4 is mounted on an end portion of the body frame 10 on the other side in the longitudinal direction (i.e., on the right side as viewed in FIGS. 1 and 2) through a support member 55. Behind the power unit 4, a cab 56 is provided in an area on one side (i.e., the lower side as viewed in FIG. 2) in the transverse direction. A control lever 57 is disposed in the cab 56 for traveling and operating the crusher. A console 58 is disposed under the cab 56 to perform other operations, setting, monitoring, etc.

The operation of the crusher according to the first embodiment will be described below.

When target materials to be crushed are loaded into the hopper 11 by a heavy machine (such as a hydraulic excavator) equipped with an appropriate working device, e.g., a grapple, the target materials are dropped to be put on the running members 17 of the feed conveyor 12 while being guided by a spreading portion of the hopper 11. Then, the target materials are substantially horizontally conveyed toward the front side of the crusher with circulating motion of the running members 17. When the target materials on the feed conveyor 12 are conveyed to a position near the pressing feeder unit 14, they come into under the pressing roller 24 and push up the pressing feeder unit 14. Then, the target materials pushing up the pressing feeder unit 14 are introduced to the crushing chamber 27 while they are pressed toward the feed conveyor 12 side under the action of dead weight of the pressing feeder unit 14. At that time, the target materials are projected into the crushing chamber 27 in a cantilevered state with their ends gripped between the pressing roller 24 and the feed conveyor 12 to serve as support points.

The projected material portions are smashed from below by the crushing bits 36 of the rotating crushing rotor 15 rotating at a high speed, whereby the target materials are going to be pushed up. At that time of smashing, the anvil 70 positioned above the target materials acts as not only a support point for restricting the smashed target materials from being moved upward and for pressing the target materials toward the feed conveyor 12 side, but also as a fixed bit for crushing the target materials by shearing in cooperation with the crushing bits 36. Accordingly, the target materials are finely crushed, i.e., subjected to primary crushing.

The target materials having been thus subjected to the primary crushing are forced to move through the crushing chamber 27 in the rotating direction of the crushing rotor 15 until the anvil 34. The target materials are further finely crushed, i.e., subjected to secondary crushing, by the anvil 34. The target materials having been thus subjected to the secondary crushing are forced to pass through a space formed between the anvil 34 and the crushing rotor 15 with the rotation of the crushing rotor 15, and to reach a position near the screen 38.

Of the target materials having reached the screen 38, those materials having sizes smaller than the diameter of the discharge holes are discharged at once from the crushing chamber 27 through the screen 38, while those materials having sizes larger than the diameter of the discharge holes continue to circulate in the crushing chamber 27 and are repeatedly smashed by the crushing bits 36 and bumped against the anvil 34 and an inner wall surface of the crushing chamber 27 so that the target materials are gradually crushed into target grain sizes (i.e., tertiary crushing). The crushed materials (crushed chips) discharged from the crushing chamber 27 are dropped onto the conveyor belt of the circulating discharge conveyor 3 through a chute (not shown). The crushed materials having dropped onto the conveyor belt are conveyed toward the front side (i.e., the right side as viewed in FIGS. 1 and 2) of the crusher and are accumulated there.

The advantages of the crusher according to the first embodiment will be described below.

For easier understanding of the advantages of the first embodiment, a crusher in which the pressing feeder unit includes no fixed bit corresponding to the anvil 70 used in the first embodiment is assumed to be a comparative example. Generally, in crushers, along with the crusher of the first embodiment, using the crushing method of smashing the crushing bit against the target materials to be crushed from below, which are introduced by the running members of the feed conveyor or the like, the target materials can be crushed into finer chips when a point (support point) where the target materials to be crushed are pressed and supported from above is positioned closer to a point (smashing point) where the crushing bit smashes against the target materials to be crushed. In the crusher of the comparative example, the support point where the target materials to be crushed are supported is a contact point between the pressing roller and the target materials (which corresponds to the contact portion 91 in the first embodiment). In trying to position the support point closer to the smashing point, however, there is a limit because of the problem with mechanical layout, e.g., the arrangement of the pressing roller and the crushing rotor. Thus, in the crusher of the comparative example, because of a limit in trying to position the support point and the smashing point closer to each other, a difficulty arises in crushing the target materials into chips finer than a certain level with the primary crushing by the crushing bit, and the target materials tend to be roughly crushed. In some cases, a longer time is required until the roughly-crushed target materials are finely crushed, and the crushed materials having relatively large sizes are discharged through the screen as they are. This may result in lowering of the crushing efficiency and a reduction in grain size quality of the crushed materials.

In contrast, in the crusher of this first embodiment, the pressing feeder unit 14 has the anvil 70 which is disposed at a position closer to the crushing rotor 15 than the contact portion 91 where the pressing roller 24 presses the target materials, and which is disposed at a position outward of the crushing rotor 15 in the radial direction. The bumping surface 71 of the anvil 70 against which the target materials bump is arranged in an opposed relation to the rotating direction of the crushing bits 36. Further, when the crushing bits 36 smash against the target materials introduced toward the crushing rotor 15, the anvil 70 presses those target materials toward the feed conveyor 12 side for crushing thereof. With such an arrangement, the anvil 70 acts not only as a fixed bit at an inlet of the crushing chamber 27, but also as a support point for pressing the target materials at a position closer to the crushing rotor 15 than the contact portion 91 of the pressing roller 24. Therefore, the support point and the smashing point can be located closer to each other than the case of the comparative example, and the crushed materials having smaller grain sizes can be obtained even in the primary crushing. As a result, the target materials can be more effectively crushed by the crushing bits 36, and the crushed materials having good grain size quality can be produced with higher efficiency.

Also, in the crusher of this first embodiment, the target materials crushed by the anvil 70 are further crushed, as described above, by the anvil 34 disposed downstream of the anvil 70 in the direction in which the target materials are forced to move in the crushing chamber 27. Accordingly, the target materials can be even more efficiently crushed by the interaction of both the fixed bits.

A modification of the first embodiment will be described below.

The modification of the first embodiment described below is featured in that the bumping surface 71 of the anvil 70 is arranged to have a difference posture during the crushing operation from that in the crusher of the first embodiment.

Figure 5:
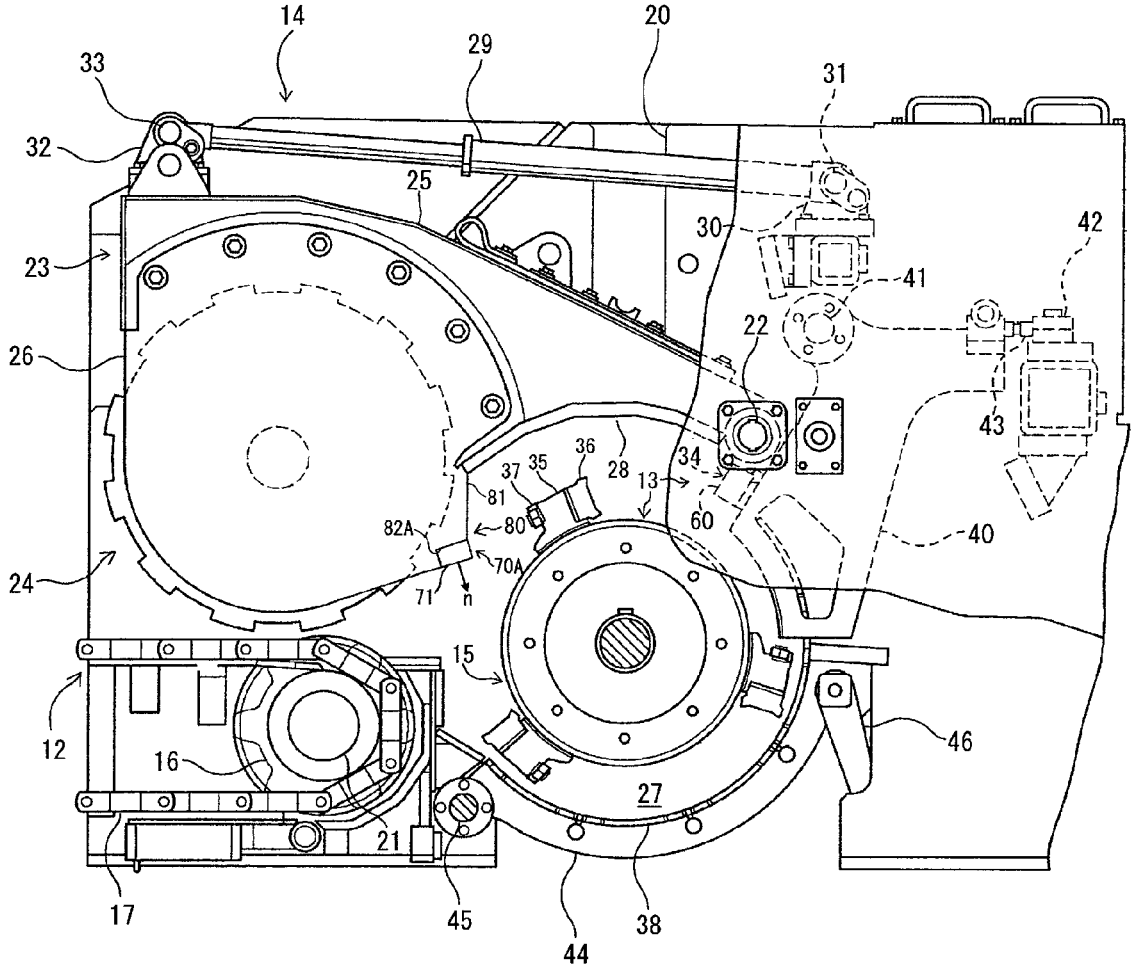
FIG. 5 is a side view showing a structure in the vicinity of the crushing apparatus provided in a crusher according to a modification of the first embodiment of the present invention.
Figure 6:
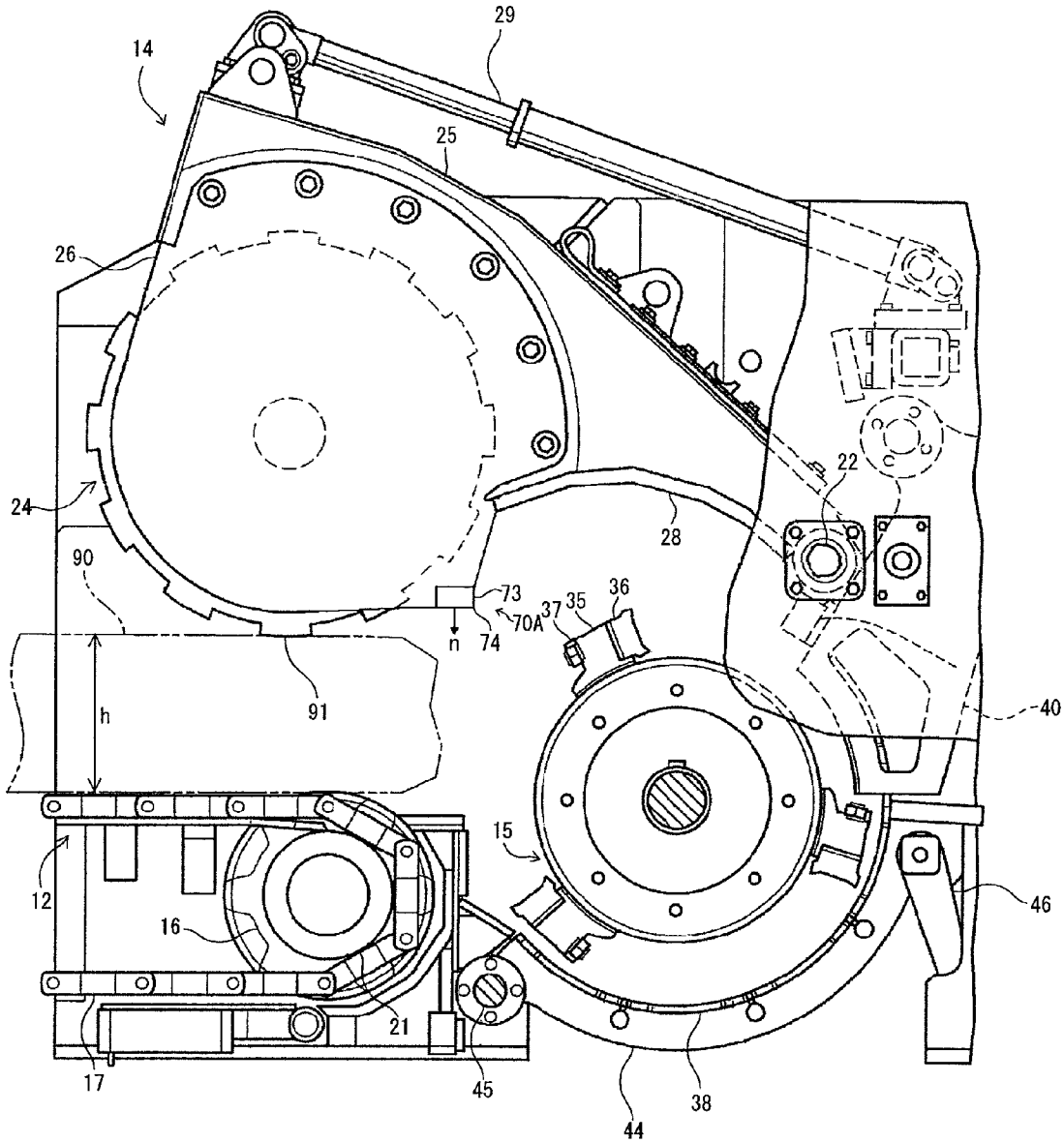
FIG. 6 is a side view showing a state of the structure shown in FIG. 5 during the crushing operation.

FIG. 5 is a side view showing a structure in the vicinity of the crushing apparatus 13 provided in a crusher according to the modification of the first embodiment of the present invention, and FIG. 6 shows a state of the structure shown in FIG. 5 during the crushing operation.

Referring to FIG. 5, the bracket portion 26 has a recess 82A, and an anvil 70A is mounted to the recess 82A in a replaceable manner by bolts, for example. Referring to FIG. 6, the bumping surface 71 of the anvil 70A is disposed at a position not lower than the height of the contact portion 91 and is arranged to be substantially horizontally held in the crushing posture while a normal line n with respect to the bumping surface 71 is directed vertically downward (i.e., downward as viewed in FIG. 6).

By mounting the anvil 70A to the bracket portion 26 with the normal line n being directed vertically downward during the crushing operation as shown in FIG. 6, the target materials 90 can be pressed by the entirety of the bumping surface 71, and energy of the bumping can be more efficiently utilized as crushing energy. Also, since the height of the conveying surface of the feed conveyor 12 and the center of rotation of the crushing rotor 15 are positioned substantially at the same level as seen from FIG. 6, the bumping surface 71 is arranged in an exactly opposed relation to the rotating direction of the crushing bits 36 at the smashing point where the crushing bits 36 smash against the target materials. That arrangement also contributes to more efficiently utilizing the bumping energy as the crushing energy. Hence the crushing efficiency can be further increased.

As another modification similar to the above-described modification, the anvil may be mounted such that the normal line n with respect to the bumping surface 71 is directed forward of the crusher body in the crushing posture. Such an arrangement is particularly advantageous in that, when the target materials are loaded, they can be smoothly introduced into the crushing chamber 27 without being caught by the edge of the anvil.

Figure 7:
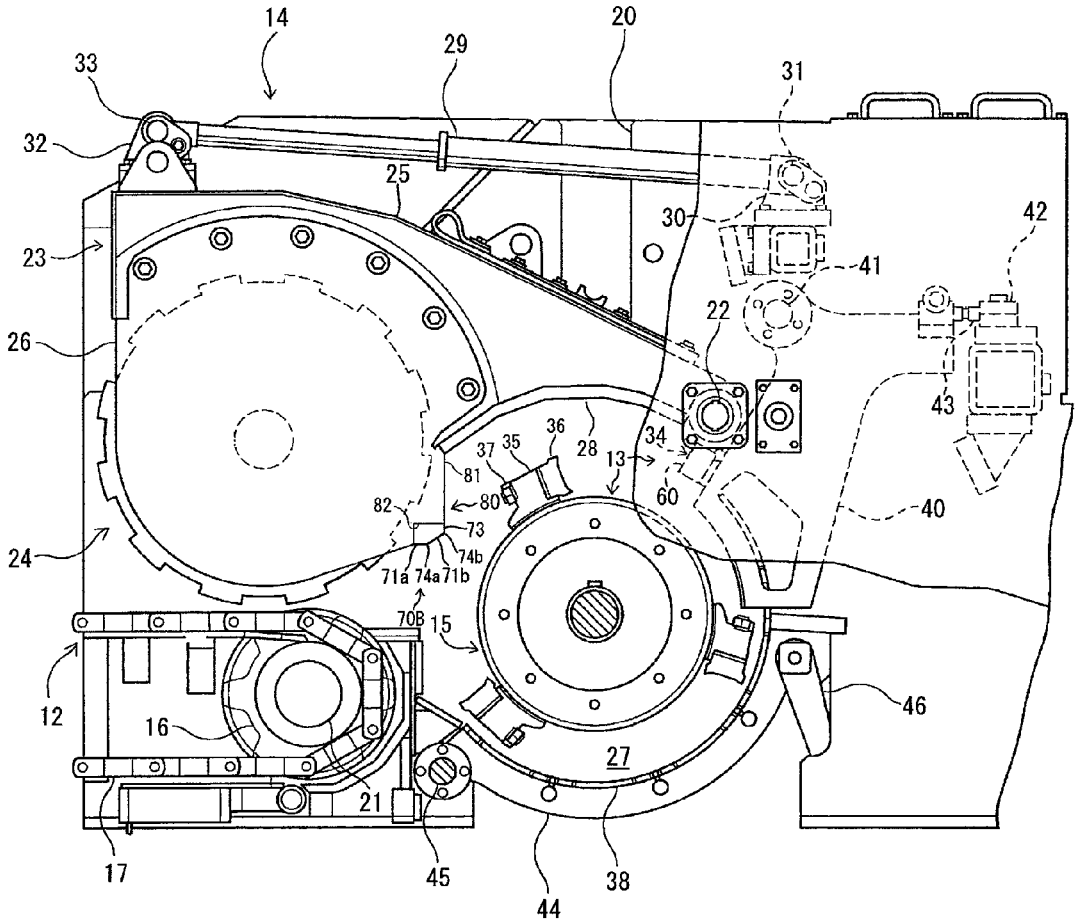
FIG. 7 is a side view showing a structure in the vicinity of the crushing apparatus provided in a crusher according to a second embodiment of the present invention.

A second embodiment of the present invention will be described below. As compared with the first embodiment, the second embodiment is featured in that the anvil (first fixed bit) has two or more bumping surfaces. FIG. 7 is a side view showing a structure in the vicinity of the crushing apparatus 13 provided in a crusher according to the second embodiment of the present invention.

Referring to FIG. 7, an anvil 70B having two bumping surfaces is mounted to the recess 82 of the bracket portion 26. More specifically, the anvil 70B has a bumping surface 71*a* positioned closer to the rear side of the crusher body, a bumping surface 71*b* positioned to continuously extend from the bumping surface 71*a* toward the front side of the crusher body, a first edge 74*a* formed by the bumping surfaces 71*a* and 71*b*, and a second edge 74*b* formed by the bumping surface 71*b* and the side surface 73. In the posture during a state other than the crushing operation, the first edge 74*a* is positioned lower than the second edge 74*b*.

By performing the crushing operation with the thus-constituted anvil 70B mounted in place, when the crushing bits 36 smash against the target materials, the target materials are first crushed by the first edge 74*a* and are then crushed by the second edge 74*b*. Thus, since the target materials are crushed in two steps by the anvil 70B, the crushing efficiency is increased.

Figure 8:
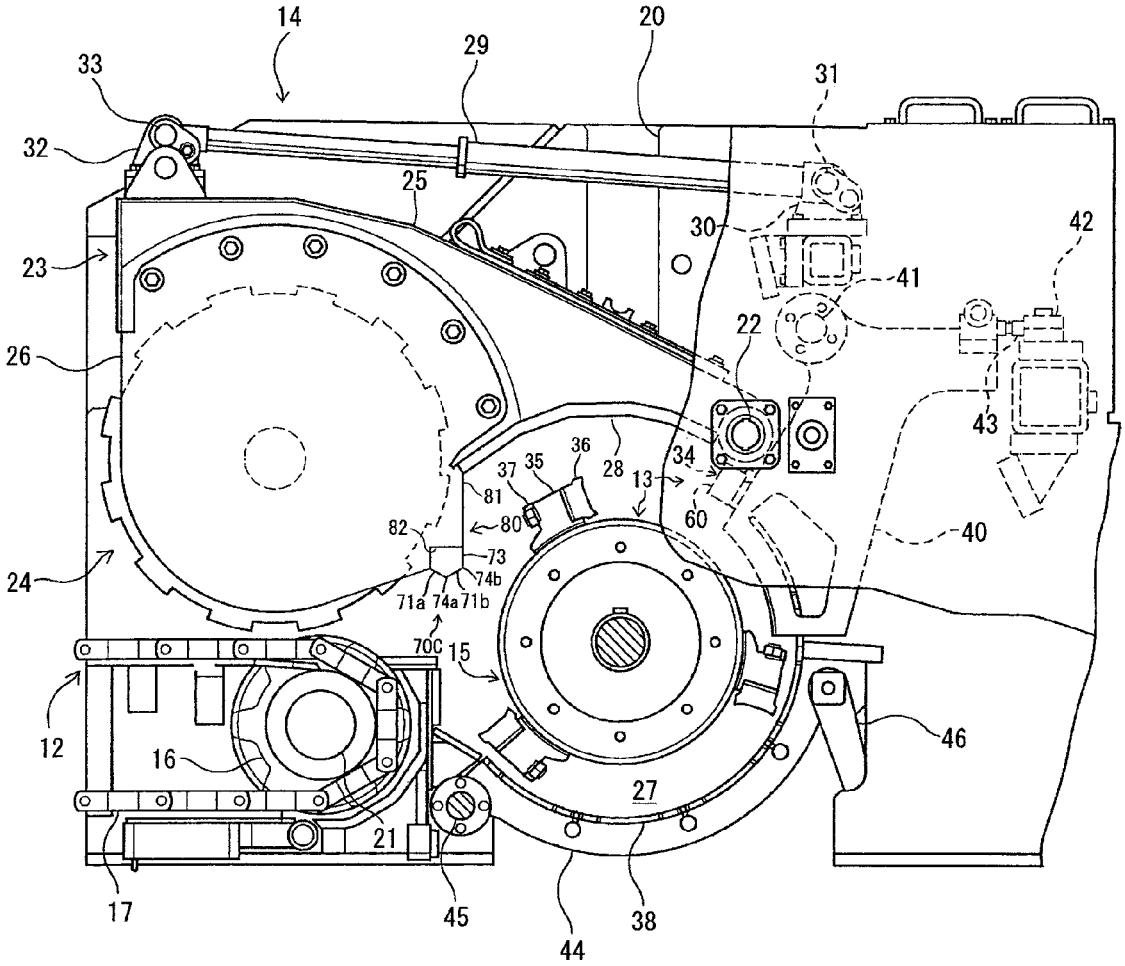
FIG. 8 is a side view showing a structure in the vicinity of the crushing apparatus provided in a crusher according to a first modification of the second embodiment of the present invention.

Another example of the anvil having two bumping surfaces is shown in FIG. 8 as a first modification of the second embodiment. FIG. 8 is a side view showing a structure in the vicinity of the crushing apparatus 13 provided in a crusher according to the first modification of the second embodiment of the present invention. Referring to FIG. 8, an anvil 70C having two bumping surfaces is mounted to the recess 82 of the bracket portion 26. As in the above-described anvil 70B, the anvil 70C has two bumping surfaces and two edges. However, the bumping surfaces 71*a* and 71*b* jointly form a bumping surface which is "downwardly projected" in the state other than the crushing operation. Such an arrangement can also provide a similar advantage to that described above. In addition to the illustrated first modification, the similar advantage can be further obtained by constituting the anvil such that the edge positioned closer to the rear side of the crusher body (i.e., the first edge 74*a*) is positioned lower than the edge positioned closer to the front side of the crusher body (i.e., the second edge 74*b*).

Figure 9:
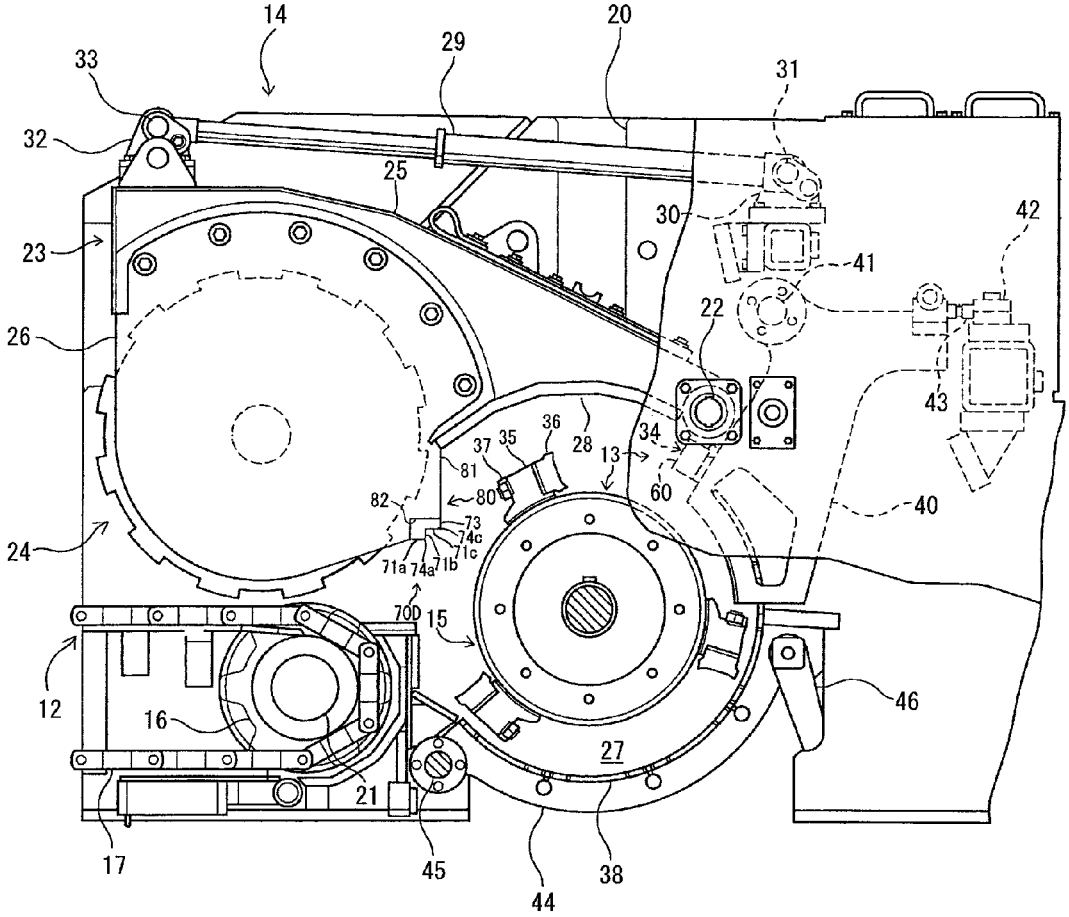
FIG. 9 is a side view showing a structure in the vicinity of the crushing apparatus provided in a crusher according to a second modification of the second embodiment of the present invention.

An example of the anvil having three bumping surfaces is shown in FIG. 9 as a second modification of the second embodiment and is described below. FIG. 9 is a side view showing a structure in the vicinity of the crushing apparatus 13 provided in a crusher according to the second modification of the second embodiment of the present invention. Referring to FIG. 9, an anvil 70D having three bumping surfaces is mounted to the recess 82 of the bracket portion 26. More specifically, the anvil 70D has a bumping surface 71*a* positioned closer to the rear side of the crusher body, a bumping surface 71*b* positioned to continuously extend from the bumping surface 71*a* toward the front side of the crusher body, a bumping surface 71*c* positioned to continuously extend from the bumping surface 71*b* toward the front side of the crusher body, a first edge 74*a* formed by the bumping surfaces 71*a* and 71*b*, a second edge 74*b* formed by the bumping surfaces 71*b* and 71*c*, and a third edge 74*c* formed by the bumping surface 71*c* and the side surface 73.

By forming three bumping surfaces as described above, a plurality of edges (particularly, the first edge 74*a* and the third edge 74*c*) are also formed, and therefore the target materials can be crushed in plural steps substantially in a similar manner to that described above. Further, by forming bumping surfaces in number over three, e.g., four bumping surfaces, so as to provide two angular protrusions, a plurality of edges can be formed appropriately as in the above-described example. Thus, even in the case of three or more bumping surfaces, it is possible to crush the target materials in plural steps and to increase the crushing efficiency.

Figure 10:
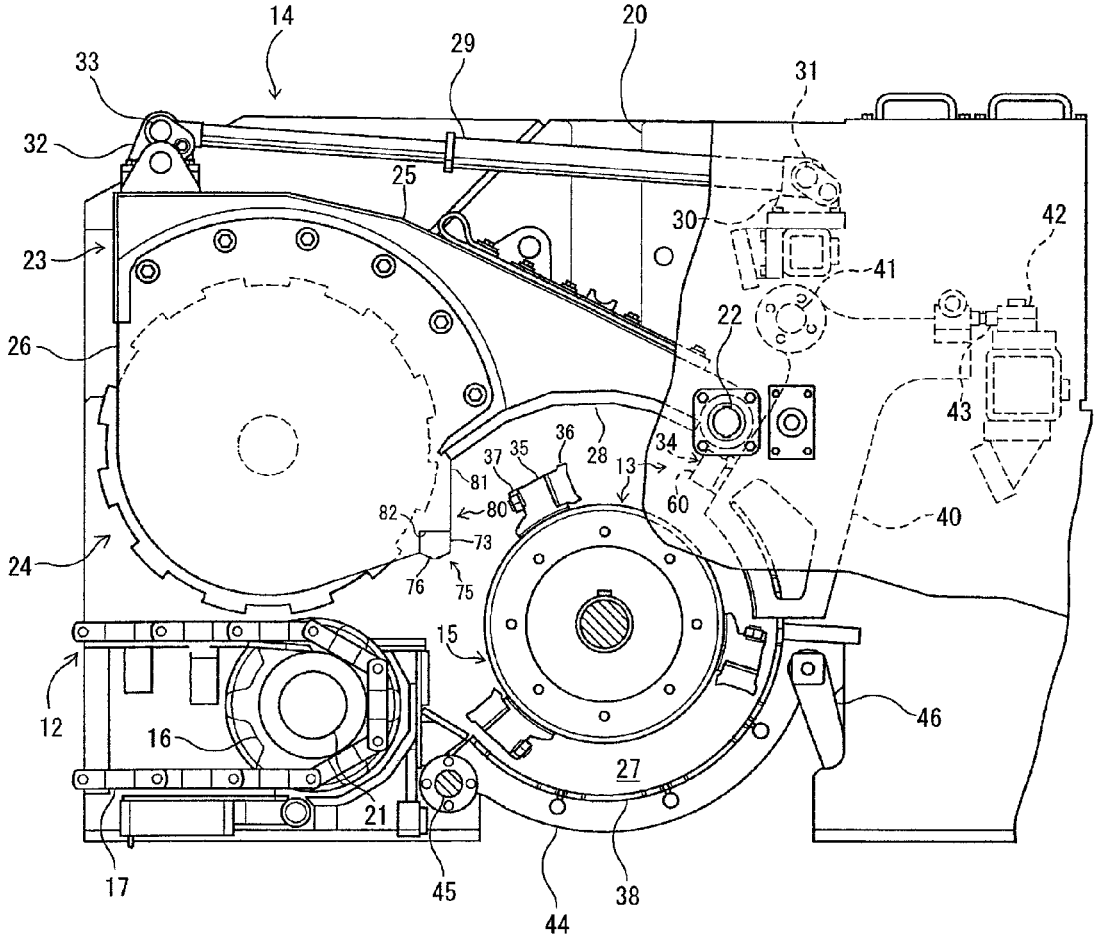
FIG. 10 is a side view showing a structure in the vicinity of the crushing apparatus provided in a crusher according to a third embodiment of the present invention.

A third embodiment of the present invention will be described below. This third embodiment is featured in having a support-point constituting portion which positively acts on the target materials as a support point, instead of the anvil 70 which acts as the support point and the fixed bit in the above-described first embodiment. FIG. 10 is a side view showing a structure in the vicinity of the crushing apparatus 13 provided in a crusher according to the third embodiment of the present invention.

Referring to FIG. 10, a support-point constituting portion 75 is mounted to the recess 82 of the bracket portion 26 such that, when the crushing bits 36 smash against the target materials introduced to the crushing rotor 15, the support-point constituting portion 75 presses the target materials toward the feed conveyor 12 side. More specifically, the support-point constituting portion 75 has a side surface 73 and a curved surface 76 which is formed to have a "downwardly projected" shape in the posture during the state other than the crushing operation. When the crushing bits 36 smash against the target materials, the curved surface 76 comes into contact with the target materials to act as a support point for pressing the target materials toward the feed conveyor 12 side. Accordingly, the support-point constituting portion 75 acts on the target materials as a support point which is positioned closer to the crushing rotor 15 than the contact portion 91. As compared with the case of pressing the target materials by only the contact portion 91, therefore, the target materials can be more finely crushed. Further, since the support-point constituting portion 75 has the curved surface 76, the target materials can be smoothly introduced to the crushing chamber 27 even when the target materials conveyed on the feed conveyor 12 contact the support-point constituting portion 75 during the crushing operation. The support-point constituting portion 75 is not limited to the above-described structure. A similar advantage to that described above can also be obtained by forming a curved surface at least in an area of the support-point constituting portion 75 which comes into contact with the target materials when the crushing bits 36 smash against the target materials.

Figure 11:
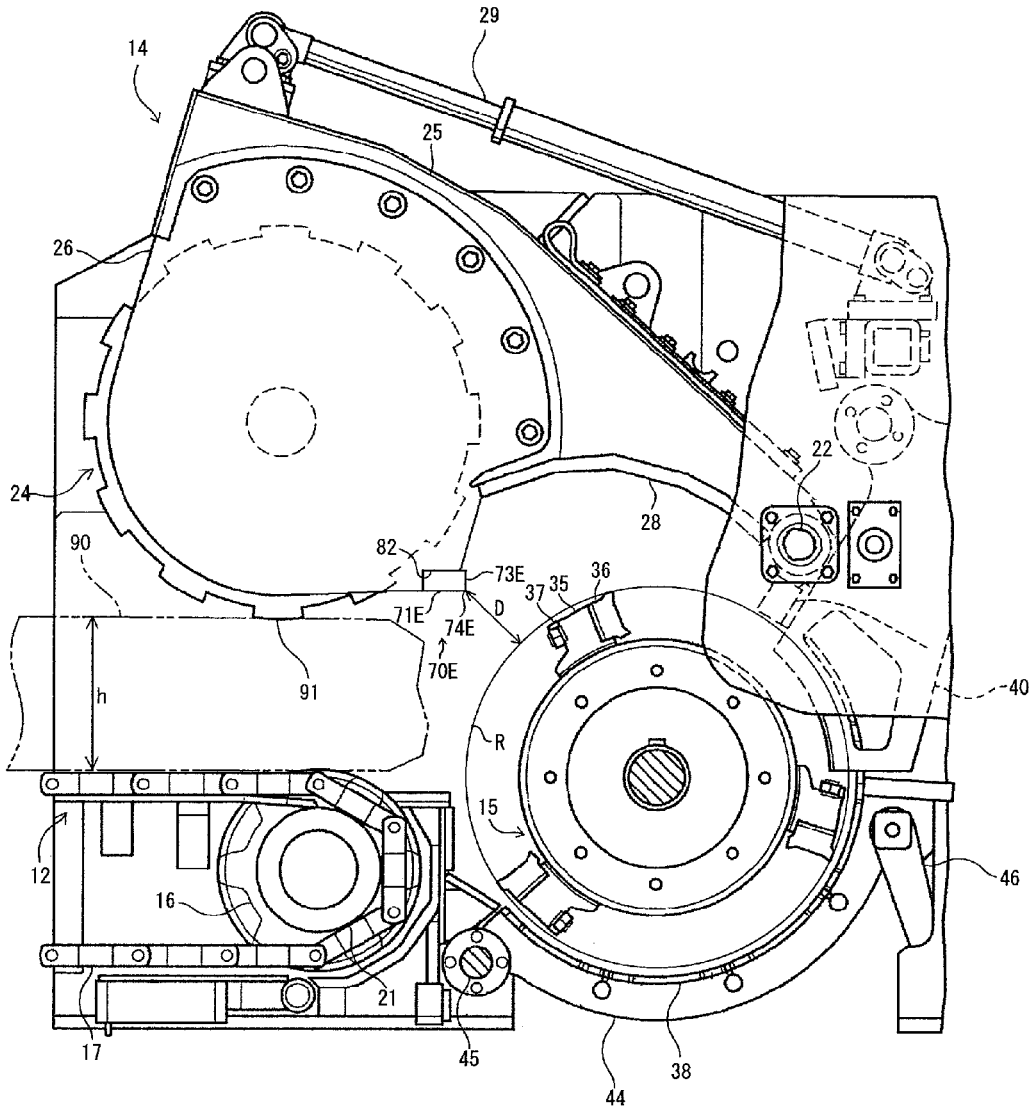
FIG. 11 is a side view showing a structure in the vicinity of the crushing apparatus during crushing operation provided in a crusher according to a fourth embodiment of the present invention.

A fourth embodiment of the present invention will be described below. This fourth embodiment is featured in making, in the anvil 70 of the first embodiment, adjustable a distance (hereinafter referred to as a "gap size D") from an inner end of the anvil in the radial direction of the crushing rotor 15 to a maximum locus R (described later) of rotation of the crushing bits 36. FIG. 11 is a side view showing a structure in the vicinity of the crushing apparatus 13 during the crushing operation provided in a crusher according to the fourth embodiment of the present invention.

Referring to FIG. 11, an anvil 70E is mounted to the recess 82 of the bracket portion 26. The anvil 70E is capable of adjusting the gap size D, i.e., the distance from its part closest to the crushing rotor 15 to the maximum locus R of rotation of the crushing bits 36 when one type of anvil is replaced with the other type. The remaining structure is the same as that in the modification of the first embodiment.

The anvil 70E has a side surface 73E which is projected into the crushing chamber 27 in the position during the crushing operation, shown in FIG. 11, to a larger extent than the side surface 73 of the anvil 70A shown in the modification of the first embodiment, a bumping surface 71E, an edge 74E formed by the bumping surface 71E and the side surface 73E. The maximum locus R of rotation of the crushing bits 36, shown in FIG. 11, represents a locus along which the outer ends of the crushing bits 36 in the radial direction of the crushing rotor 15 rotate. In the anvil 70E of this fourth embodiment, its part closest to the crushing rotor 15 (i.e., the inner end of the anvil 70E in the radial direction of the crushing rotor 15) is the edge 74E. The edge 74E is positioned on the inner side than the edge 74 of the anvil 70A in the radial direction of the crushing rotor 15 to form a gap with the size D between the edge 74E and the maximum locus R of rotation of the crushing bits 36.

Further, in the crusher of this fourth embodiment, in addition to the above-described anvil 70E having the edge 74E, there are prepared other plural types of anvils (not shown) which have edges with different distances (sizes D) up to the maximum rotation locus R. In the crusher of this fourth embodiment, the gap size D can be adjusted by replacing the plural types of anvils from one to another as required. Thus, since the gap size D can be adjusted to a value suitable for the desired grain size of the crushed materials, it possible to improve the grain size quality of the crushed chips and to increase the crushing efficiency. The above description has been made in connection with the case of adjusting the distance from the edge 74E to the maximum rotation locus R in the posture during the crushing operation. However, when another part of the anvil is positioned closest to the maximum locus R of rotation of the crushing bits 36 in the radial direction of the crushing rotor 15, a similar advantage to the above-described one can also be of course obtained by adjusting the gap size D on the basis of such a part of the anvil.

Moreover, the above description has been made of, by way of example, the case where the present invention is applied to a self-propelled crusher, but the present invention is not limited to such an application. As a matter of course, the present invention is also applicable to, e.g., a mobile crusher capable of traveling with traction, a transportable crusher capable of being lifted by, e.g., a crane for transportation, and a stationary crusher installed as a fixed machine in a plant or the like. Any of those applications can also provide similar advantages to those obtainable with the above-described embodiments. In addition, the crusher of the present invention can be used to crush woods, waste plastics, waste tatami (straw matting), bamboos, etc. as target materials, and can provide similar advantages to those described above regardless of the type of target materials to be crushed.

What is claimed is:

1. A crusher comprising:

a crushing rotor being rotatable and having a crushing bit to crush target materials to be crushed;

a feed conveyor for conveying the target materials toward said crushing rotor; and a pressing feeder unit including a pressing roller disposed above said feed conveyor and introducing the target materials on said feed conveyor toward said crushing rotor while pressing the target materials from above, and a fixed bit disposed at a position which is closer to said crushing rotor than a point where said pressing roller presses the target materials and which is outward of said crushing rotor in the radial direction, said fixed bit having a bumping surface, against which the target materials bump, disposed in an opposed relation to the rotating direction of said crushing bit, thereby crushing the target materials introduced toward said crushing rotor.

2. The crusher according to claim 1, wherein the bumping surface of said fixed bit is arranged at a level not lower than the height of a lower end portion of said pressing roller during crushing operation.

3. The crusher according to claim 1, wherein said fixed bit is replaceable with another type of fixed bit.

4. The crusher according to claim 3, wherein a gap size from a part of said fixed bit closest to said crushing rotor to a maximum locus of rotation of said crushing bit is adjustable by replacing said fixed bit with another type of fixed bit.

5. A crusher comprising:

a crushing rotor being rotatable and having a crushing bit to crush target materials to be crushed;

a feed conveyor for conveying the target materials toward said crushing rotor; and a pressing feeder unit including a pressing roller disposed above said feed conveyor and introducing the target materials on said feed conveyor toward said crushing rotor while pressing the target materials from above, and a support-point constituting portion disposed at a position closer to said crushing rotor than a point where said pressing roller presses the target materials, said support-point constituting portion acting, when said crushing bit smashes against the target materials introduced toward said crushing rotor, to press the target materials toward the feed conveyor side.

6. A crusher comprising:

a crushing rotor being rotatable and having a crushing bit to crush target materials to be crushed;

a feed conveyor for conveying the target materials toward said crushing rotor;

a pressing feeder unit including a pressing roller disposed above said feed conveyor and introducing the target materials on said feed conveyor toward said crushing rotor while pressing the target materials from above, and a first fixed bit disposed at a position which is closer to said crushing rotor than a point where said pressing roller presses the target materials and which is outward of said crushing rotor in the radial direction, said first fixed bit having a bumping surface, against which the target materials bump, disposed in an opposed relation to the rotating direction of said crushing bit, thereby acting, when said crushing bit smashes against the target materials introduced toward said crushing rotor, to press the target materials toward the feed conveyor side for crushing of the target materials; and a second fixed bit disposed at a position downstream of said first fixed bit in a direction in which the target materials are forced to move and which is outward of said crushing rotor in the radial direction, said second fixed bit having a bumping surface, against which the target materials bump, disposed in an opposed relation to the rotating direction of said crushing bit, thereby further crushing the target materials having been crushed by said first fixed bit.

* * * * *